US009698473B2

(12) United States Patent
Ito et al.

(10) Patent No.: US 9,698,473 B2
(45) Date of Patent: Jul. 4, 2017

(54) VEHICLE-MOUNTED ANTENNA DEVICE

(71) Applicant: HARADA INDUSTRY CO., LTD., Tokyo (JP)

(72) Inventors: Jun Ito, Tokyo (JP); Daisuke Ito, Tokyo (JP); Junichi Kawahata, Tokyo (JP); Hiroki Ujiie, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/786,483

(22) PCT Filed: Apr. 21, 2014

(86) PCT No.: PCT/JP2014/061144
§ 371 (c)(1),
(2) Date: Oct. 22, 2015

(87) PCT Pub. No.: WO2014/175207
PCT Pub. Date: Oct. 30, 2014

(65) Prior Publication Data

US 2016/0079661 A1 Mar. 17, 2016

(30) Foreign Application Priority Data

Apr. 22, 2013 (JP) ..... 2013-089599

(51) Int. Cl.
*H01Q 1/32* (2006.01)
*H01Q 1/38* (2006.01)
(Continued)

(52) U.S. Cl.
CPC ..... *H01Q 1/32* (2013.01); *H01Q 1/3283* (2013.01); *H01Q 1/38* (2013.01); *H01Q 1/48* (2013.01); *H01Q 9/42* (2013.01)

(58) Field of Classification Search
None
See application file for complete search history.

(56) References Cited

U.S. PATENT DOCUMENTS 6,057,803 A * 5/2000 Kane ..... H01Q 1/32 343/713
6,927,736 B1 * 8/2005 Kornbau ..... H01Q 1/3275 343/711
(Continued)

FOREIGN PATENT DOCUMENTS

JP H06-027353 2/1994
JP 2005-104330 A 4/2005
(Continued)

OTHER PUBLICATIONS

International Search Report in PCT/JP2014/061144 dated Apr. 21, 2014.

*Primary Examiner* — Dameon E Levi
*Assistant Examiner* — Andrea Lindgren Baltzell
(74) *Attorney, Agent, or Firm* — Global IP Counselors, LLP

(57) ABSTRACT

An antenna device that is built inside a hollow body fixed to a vehicle comprises a composite antenna element that has an antenna length corresponding to a first frequency band and is bent so as to also function as a capacitive antenna corresponding to a second frequency band and to improve an antenna effective capacitance and that is disposed in a substantially planar manner. The composite antenna element is disposed such that a planar direction thereof is inclined toward a vertical-direction side with respect to a metal body of the vehicle, and is offset-disposed to a left or right side in the hollow body with respect to a vehicle traveling direction, and is grounded in a metal portion of the vehicle near a position where the composite antenna element is disposed.

19 Claims, 3 Drawing Sheets

(51) Int. Cl.
*H01Q 9/42* (2006.01)
*H01Q 1/48* (2006.01)

(56) References Cited

U.S. PATENT DOCUMENTS

| | | | | |
|---|---|---|---|---|
| 7,511,675 | B2 | 3/2009 | Puente-Baliarda et al. | |
| 8,519,898 | B2 | 8/2013 | Sampo et al. | |
| 2008/0018544 | A1 | 1/2008 | Rozan | |
| 2009/0015495 | A1 | 1/2009 | Yoshie | |
| 2013/0249747 | A1* | 9/2013 | Hijirikawa ..... | H01Q 1/32<br>343/712 |

FOREIGN PATENT DOCUMENTS

| | | | |
|---|---|---|---|
| JP | 2006-222657 | A | 8/2006 |
| JP | 2006-524449 | A | 10/2006 |
| JP | 2008-505576 | A | 2/2008 |
| JP | 2008-62746 | A | 3/2008 |
| JP | 2008-283609 | A | 11/2008 |
| JP | 2009-021648 | A | 1/2009 |
| JP | 2010274821 | A | 12/2010 |
| JP | 2011-035519 | A | 2/2011 |
| JP | 2011-166612 | A | 8/2011 |
| JP | 2012-34226 | A | 2/2012 |

* cited by examiner

VEHICLE-MOUNTED ANTENNA DEVICE

CROSS-REFERENCE TO RELATED APPLICATIONS

This U.S. National stage application of International Patent Application No. PCT/JP2014/061144, filed on Apr. 21, 2014, which, in turn, claims priority under 35 U.S.C. §119(a) to Japanese Patent Application No. 2013-089599, filed in Japan on Apr. 22, 2013, the entire contents of which are hereby incorporated herein by reference.

TECHNICAL FIELD

The present invention relates to a vehicle-mounted antenna device, and more particularly to a vehicle-mounted antenna device that supports a plurality of frequency bands and is built inside a hollow body such as a spoiler or a back door.

BACKGROUND ART

A pillar antenna, roof-mounted antenna, and glass antenna are among the antenna devices that are mounted on a vehicle to support a plurality of frequency bands, or, for example, the antenna devices that support AM and FM bands. However, the pillar antenna, which protrudes greatly, is at high risk of being bent by contact or any other trouble. The roof-mounted antenna needs to be folded or removed in such places as a multistory car park and an automatic car-washing machine because of a higher ground clearance. The problem with the glass antenna is that the antenna involves a specific development for each vehicle model, leading to higher development and production costs and the like. In recent years, great importance has been attached to the design of vehicles. There is growing demand for the vehicle-mounted antenna devices that do not ruin the appearance of vehicles as much as possible. Various antennas that could be built inside a spoiler have been developed so that the appearance is not ruined.

For example, there are such things as a linear monopole antenna element that is disposed from the left end of a vehicle to the right end in space inside a spoiler. Moreover, for example, Japanese Patent Application Kokai Publication No. 2011-035519 discloses an antenna device supporting AM and FM bands, whose antenna is built inside a spoiler. Japanese Patent Application Kokai Publication No. 2008-283609 discloses an example in which a radio or digital TV antenna is disposed in a spoiler.

SUMMARY

However, in the case of the conventional techniques, the antenna is disposed at the center between the left and right ends of the spoiler with respect to a direction in which the vehicle travels. Usually, at around the center of the spoiler, a high-mount stop lamp has been installed. In such a case, the problem is that, due to the interference with the high-mount stop lamp, S/N characteristics would be worsened. If a sub-antenna is used, another problem is a mutual coupling with the sub-antenna. Furthermore, if an antenna element is disposed at the center between the left and right ends with respect to the vehicle traveling direction, null could occur in the directivity. More specifically, in the FM band, null occurs in the vehicle front-rear direction with respect to horizontal polarized waves. With respect to vertically polarized waves, null occurs in the vehicle left-right direction. As a result, the gain tends to deteriorate. Thus, depending on the receiving direction, a variation could occur in the reception precision.

In view of such a situation, the present invention is intended to provide a vehicle-mounted antenna device with improved S/N characteristics and directivity.

To achieve the above-described object of the present invention, a vehicle-mounted antenna device of the present invention may include a composite antenna element that has an antenna length corresponding to a first frequency band and is bent so as to also function as a capacitive antenna corresponding to a second frequency band and to improve an antenna effective capacitance and that is disposed in a substantially planar manner, wherein the composite antenna element is disposed such that a planar direction thereof is inclined toward a vertical-direction side with respect to a metal body of the vehicle, and is offset-disposed to a left or right side in the hollow body with respect to a vehicle traveling direction, and is grounded in a metal portion of the vehicle near a position where the composite antenna element is disposed.

The composite antenna element may be at least one of a meander shape, a spiral shape, and a space-filling curve shape.

The composite antenna element may be disposed so as not to interfere with a high-mount stop lamp placed near a center of the hollow body.

The vehicle-mounted antenna device may further include a sub-antenna, wherein the sub-antenna is offset-disposed on a side opposite to a position where the composite antenna element is offset-disposed.

The sub-antenna may be placed on glass inside or near the hollow body.

The vehicle-mounted antenna device may further include an amplifier circuit for the composite antenna element, wherein the composite antenna element is provided on an antenna substrate, and the amplifier circuit is provided on an amplifier substrate that is different from the antenna substrate.

The composite antenna element may be disposed such that a planar direction thereof is substantially perpendicular to the metal body of the vehicle.

The advantage of the vehicle-mounted antenna device of the present invention is that the S/N characteristics and directivity can be improved.

DETAILED DESCRIPTION OF EMBODIMENTS

Figure 1A:
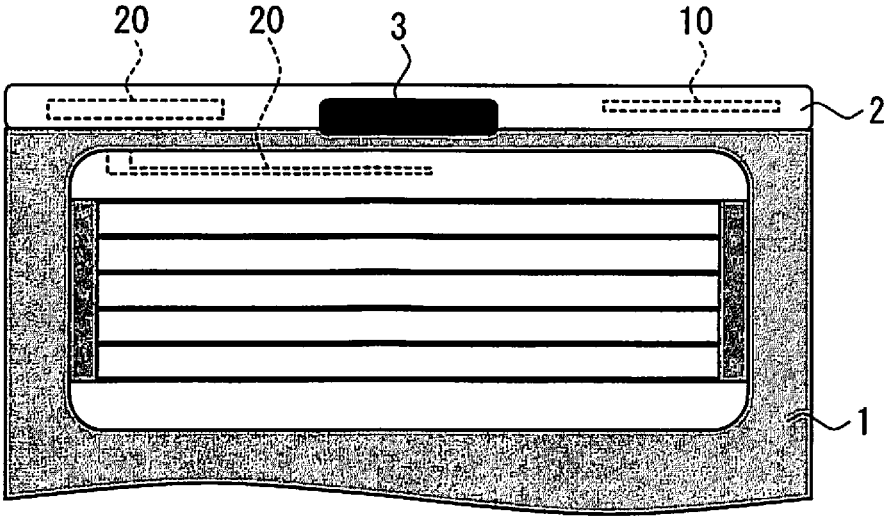
FIGS. 1A through 1D are schematic diagrams for explaining a vehicle-mounted antenna device according to a disclosed embodiment.
Figure 1B:
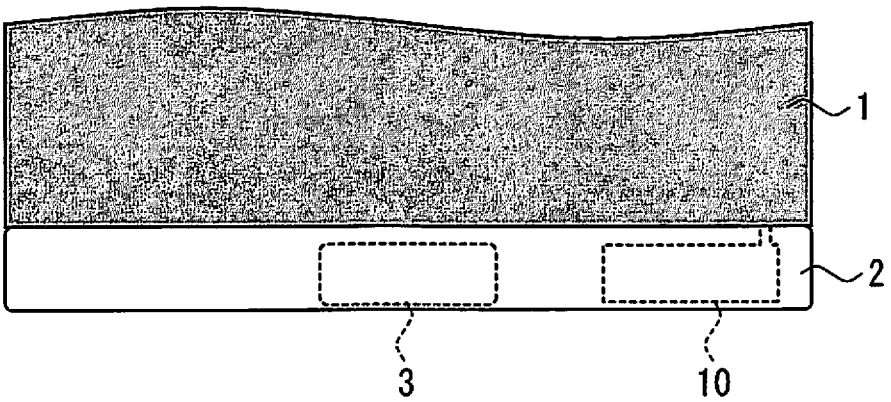
Figure 1C:
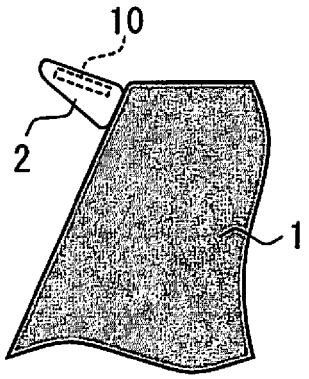
Figure 1D:
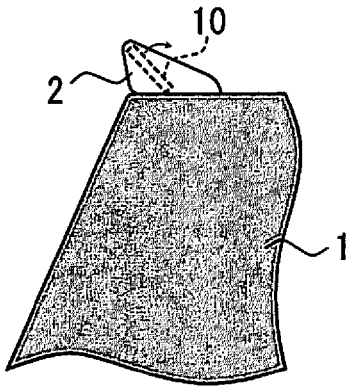

Hereinafter, an embodiment of the present invention will be described together with examples shown in the accompanying drawings. A vehicle-mounted antenna device of the present invention is built inside a hollow body fixed to a vehicle, such as vehicle exterior parts like a spoiler, or a back door. FIGS. 1A through 1D illustrate schematic diagrams for explaining exemplary embodiments of the vehicle-mounted antenna device according to the present invention. FIG. 1A is a front view, FIG. 1B is a top view, FIG. 1C is a side view, and FIG. 1D is a side view of another example. More specifically, FIG. 1A is a view of a back door side. FIG. 1B is a view of a vehicle roof side. As shown in the diagram, the vehicle-mounted antenna device of the present invention includes a composite antenna element 10, which is built inside a spoiler 2 that is fixed to a vehicle 1, for example. In the example shown in the diagrams, the composite antenna element 10 is built inside the rear spoiler. In this case, the spoiler is a so-called aero part that is provided on an outer side of a vehicle body in terms of vehicle's aerodynamics and design. In addition, the vehicle-mounted antenna device of the present invention is not limited to those built inside the spoiler. The vehicle-mounted antenna device may also be built inside a hollow body such as a resin back door, resin roof, or resin trunk, as long as the hollow body allows radio waves to pass therethrough or is not covered with metal or the like.

The composite antenna element 10 has an antenna length corresponding to a first frequency band. The composite antenna element 10 is bent so as to improve an antenna effective capacitance and thereby also function as a capacitive antenna corresponding to a second frequency band. The composite antenna element 10 is disposed in a substantially planar manner.

The first frequency band may be a radio FM band or any other frequency band, such as DAB (Digital Audio Broadcast) or UHF (Ultra-High Frequency), for example. The antenna element may have an antenna length that is, for example, one-fourth of a target frequency, depending on those frequency bands. The second frequency band may be a radio AM band or the like, for example. According to the present invention, in order to support the second frequency band, the antenna element used is bent so that the antenna element functions as a capacitive antenna. That is, the antenna element has an antenna length corresponding to the first frequency band while being bent in a substantially planar manner to improve the antenna effective capacitance and thereby work as a capacitive antenna corresponding to the second frequency band. For example, the bent element may be at least one of a meander shape, a spiral shape, and a space-filling curve shape, for example.

Figure 2A:
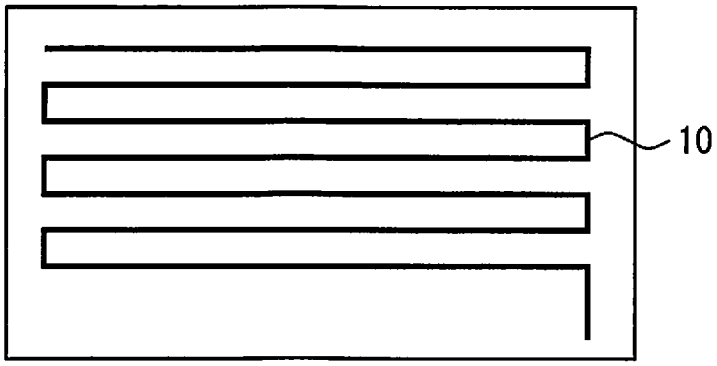
FIGS. 2A through 2C illustrate specific examples showing that the vehicle-mounted antenna device according to the disclosed embodiments can be used as a composite antenna element.
Figure 2B:
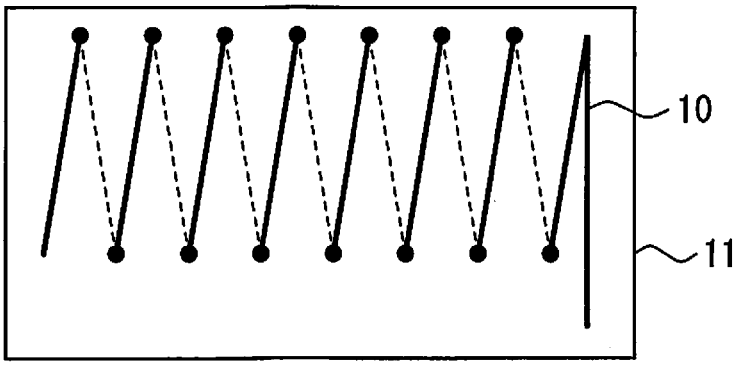
Figure 2C:
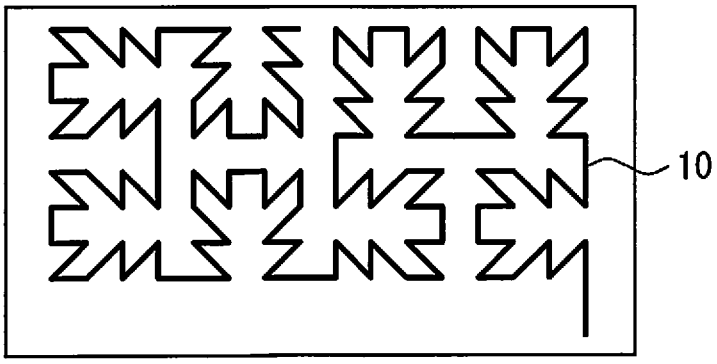

FIGS. 2A through 2C illustrate several specific examples proving that the vehicle-mounted antenna device of the present invention can be used as a composite antenna element. FIG. 2A shows an example of the meander shape. FIG. 2B shows an example of the spiral shape. FIG. 2C shows an example of the space-filling curve shape. In addition, the present invention is not limited to the examples shown in the diagram. The element can take any shape as long as the antenna is disposed and bent so as to work as a capacitive antenna and has an element length corresponding to a predetermined frequency band. Moreover, the various shapes may be appropriately used in combination. In the case of the vehicle-mounted antenna device of the present invention, the composite antenna element 10 can take various element shapes in accordance with the internal space of the spoiler 2, for example. Here, below is an explanation of what "substantially planar manner" is. For example, as shown in FIG. 2B, if the composite antenna element 10 is disposed in a spiral manner on both sides of a double-sided printed circuit hoard of an antenna substrate 11 via through-holes, the composite antenna element 10 does not exist only on the one-side surface of the board, and therefore it cannot be strictly said that the element is disposed in a planar manner. However, even in such a situation, the element functions as a composite antenna element. Therefore, the term "substantially planar manner" also refers to such a situation.

Moreover, the composite antenna element 10 is not limited to those disposed on the board. The composite antenna element 10 may be disposed on film, like a film antenna. The composite antenna element 10 may be laid directly on a housing of the vehicle-mounted antenna device or the like.

As shown in FIG. 1C, which is a side view, the composite antenna element 10 is disposed such that a planar direction thereof is substantially perpendicular to a metal body of the vehicle 1. For your information, the term "substantially perpendicular" does not mean that the direction must be exactly perpendicular to the metal body, and the direction may be tilted at some angle to the perpendicularity in line with the internal space of the spoiler 2, for example. Since the metal body of the vehicle 1 is electrically conductive, the metal body could be coupled with the composite antenna element 10. In order to reduce the amount of coupling, the composite antenna element 10 is preferably substantially perpendicular to the metal body of the vehicle 1. That is, in order to reduce the amount of coupling, the composite antenna element 10 should be disposed and inclined as much close as possible to a vertical direction side with respect to the metal body. For example, as shown in FIG. 1D, which is a side view, the spoiler 2 may be disposed on a roof side of the metal body of the vehicle 1. In such a case, in the internal space of the spoiler 2, which is a hollow body, the vehicle traveling-direction side of the composite antenna element 10 is brought down as much as possible, and the side opposite to the vehicle traveling direction is directed upward. That is, the composite antenna element 10 should be disposed and inclined toward the vertical direction side with respect to the metal body. In this manner, in the case of the vehicle-mounted antenna device of the present invention, the planar direction of the composite antenna element is not parallel to the metal body, but the composite antenna element could be disposed and inclined toward the vertical direction side. In this manner, the amount of coupling with the metal body can be reduced.

Furthermore, as shown in FIG. 1A, which is a front view, and FIG. 1B, which is a top view, the composite antenna element 10, which is used in the vehicle-mounted antenna device of the present invention, is offset-disposed toward either the left or right side inside the spoiler, for example, with respect to the vehicle traveling direction. The composite antenna element 10 is grounded on a metal portion of the vehicle 1 that is near a position where the composite antenna element 10 has been offset-disposed. In the example shown in the diagram, the composite antenna element 10 has been offset-disposed toward the right side when viewed from the rear of the vehicle. However, the present invention is not limited to this, but the composite antenna element 10 may be offset-disposed toward the left side.

As for the offset placement position of the composite antenna element 10, all that is required is for the position not to interfere with a high-mount stop lamp 3, which is disposed near the center of the spoiler. If the antenna element is disposed so as to overlap with the high-mount stop lamp 3, the S/N characteristics would deteriorate due to the interference with the high-mount stop lamp 3. Accordingly, the composite antenna element 10 should be disposed at near the left or right end so as to avoid the high-mount stop lamp 3, which is disposed near the center.

Figure 3A:
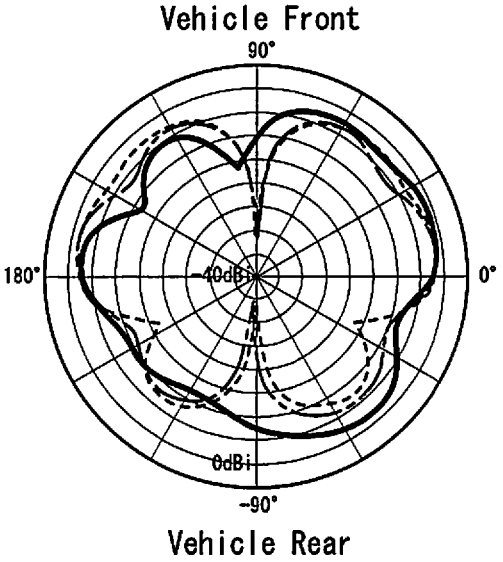
FIGS. 3A and 3B illustrate diagrams for explaining directivity of the vehicle-mounted antenna device according to the disclosed embodiments.
Figure 3B:
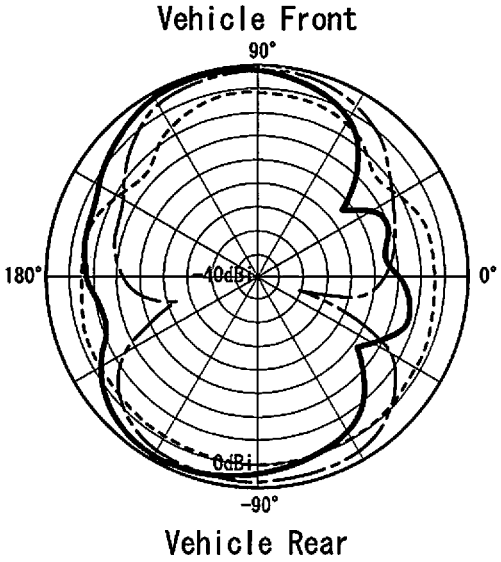

Since the composite antenna element 10 is offset-disposed, as described below, the directivity is improved. FIGS. 3A and 3B illustrate diagrams for explaining the directivity of the vehicle-mounted antenna device of the present invention. FIG. 3A shows the directivity of horizontally polarized waves of the FM band. FIG. 3B shows the directivity of vertically polarized waves of the FM band. Here, as comparative examples, the characteristics of a conventional linear monopole antenna element are represented by dotted line, and the characteristics at a time when the element is disposed at the center are represented by alternate long and short dash line. As shown in the diagram, as for the characteristics of horizontally polarized waves, when the linear monopole antenna element is used or when the element is disposed at the center, null occurs in the front-rear direction of the vehicle traveling direction. As for the characteristics of vertically polarized waves, when the linear monopole antenna element is used or when the element is disposed at the center, null occurs in the left-right direction of the vehicle traveling direction. Meanwhile, in the case of the vehicle mounted antenna device of the present invention, since the antenna element has been offset-disposed, the waves do not cancel each other in the left and right areas due to an uneven radiation pattern in the left-right direction with the help of the metal body shape of the vehicle 1. Therefore, the gain does not deteriorate significantly in any direction. As a result, the average gain is increased, and the deviation of the directivity is low.

Moreover, in the vehicle-mounted antenna device of the present invention, the offset-disposing of the composite antenna element 10 creates a space on the side opposite to the position where the composite antenna element 10 is offset-disposed. For example, a sub-antenna 20 may be offset-disposed on the side opposite to the position where the composite antenna element 10 is offset-disposed. The sub-antenna 20 is, for example, an FM-band sub-antenna, and may constitute a diversity antenna along with the main antenna or the composite antenna element. The sub-antenna 20 may be disposed inside the spoiler and on the side opposite to the position where the composite antenna element 10 is offset-disposed, or may be disposed on glass near the spoiler and on the side opposite to the offset placement position. The sub-antenna 20 is not limited to an FM-band antenna, and the sub-antenna 20 can be an antenna for any other frequency band, such as DAB or DTV. The sub-antenna can be placed in a position where a mutual coupling does not occur. As a result, a further composite antenna can be made. The problem with the conventional linear monopole antenna element is a mutual coupling with the sub-antenna, because the liner element exists across the entire spoiler. However, according to the present invention, the sub-antenna can be disposed on the side opposite to the offset placement position of the composite antenna element. Therefore, the effects of the mutual coupling can be reduced.

Figure 4:
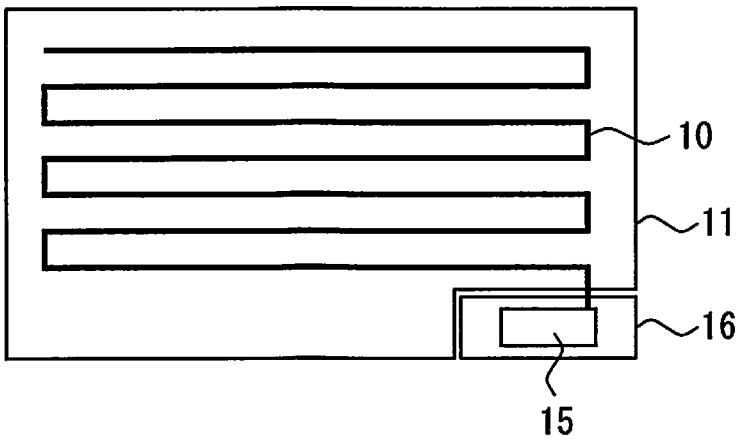
FIG. 4 is a schematic plan view for explaining an example in which a composite antenna element of the vehicle-mounted antenna device according to the disclosed embodiments is provided on a substrate.

An example in which the composite antenna element 10 is provided on a substrate will be described with reference to FIG. 4. FIG. 4 is a schematic plan view for explaining an example in which the composite antenna element of the vehicle-mounted antenna device of the present invention is provided on the substrate. In the drawing, the same reference numerals as those in FIGS. 1A through 1D denote the same parts as those in FIG. 4. As shown in the diagram, the composite antenna element 10 is provided on an antenna substrate 11. An amplifier circuit 15 for the composite antenna element 10 is connected to the composite antenna element 10. In the example shown in the diagram, the amplifier circuit 15 is provided on an amplifier substrate 16, which is different from the antenna substrate 11. This configuration makes it possible to change the antenna substrate in various ways, for example, in accordance with the size, shape and other factors of the hollow body, such as spoiler, thereby contributing to an increase in the versatility. Moreover, this configuration makes maintenance of the amplifier circuit easier. Furthermore, according to this configuration, soldering of parts of the amplifier circuit or the like is carried out only on the amplifier substrate, which is separated from the larger antenna substrate. As a result, the productivity is improved, and the yield is increased. For your information, the antenna substrate and the amplifier substrate are not limited to a printed board, and the antenna substrate and the amplifier substrate may be a film-like board, such as a flexible substrate.

The vehicle-mounted antenna device of the present invention is not limited to those described above with reference to the drawings. Various changes may be made without departing from the scope of the present invention.

The invention claimed is:

1. A vehicle-mounted antenna device that is built inside a hollow body fixed to a vehicle, the vehicle-mounted antenna device comprising:

a composite antenna element that has an antenna length corresponding to a first frequency band and is bent so as to also function as a capacitive antenna corresponding to a second frequency band and to improve an antenna effective capacitance and is disposed in a substantially planar manner, the composite antenna element is disposed such that a planar direction thereof is inclined toward a vertical-direction side with respect to a metal body of the vehicle, and is offset-disposed to a left or right side in the hollow body with respect to a vehicle traveling direction so as to avoid near a center between left and right ends of the hollow body, and is grounded in a metal portion of the vehicle near a position where the composite antenna element is disposed.

2. The vehicle-mounted antenna device according to claim 1, wherein the composite antenna element is at least one of a meander shape, a spiral shape, and a space-filling curve shape.

3. The vehicle-mounted antenna device according to claim 1, wherein the composite antenna element is disposed so as not to interfere with a high-mount stop lamp placed near the center of the hollow body.

4. The vehicle-mounted antenna device according to claim 1, further comprising a sub-antenna, wherein the sub-antenna is offset-disposed on a side opposite to a position where the composite antenna element is offset-disposed.

5. The vehicle-mounted antenna device according to claim 4, wherein the sub-antenna is placed on glass inside or near the hollow body.

6. The vehicle-mounted antenna device according to claim 1, further comprising an amplifier circuit for the composite antenna element, wherein the composite antenna element is provided on an antenna substrate, and the amplifier circuit is provided on an amplifier substrate that is different from the antenna substrate.

7. The vehicle-mounted antenna device according to claim 1, wherein the composite antenna element is disposed such that a planar direction thereof is substantially perpendicular to the metal body of the vehicle.

8. The vehicle-mounted antenna device according to claim 2, wherein the composite antenna element is disposed so as not to interfere with a high-mount stop lamp placed near the center of the hollow body.

9. The vehicle-mounted antenna device according to claim 2, further comprising a sub-antenna, wherein the sub-antenna is offset-disposed on a side opposite to a position where the composite antenna element is offset-disposed.

10. The vehicle-mounted antenna device according to claim 3, further comprising a sub-antenna, wherein the sub-antenna is offset-disposed on a side opposite to a position where the composite antenna element is offset-disposed.

11. The vehicle-mounted antenna device according to claim 2, further comprising an amplifier circuit for the composite antenna element, wherein the composite antenna element is provided on an antenna substrate, and the amplifier circuit is provided on an amplifier substrate that is different from the antenna substrate.

12. The vehicle-mounted antenna device according to claim 3, further comprising an amplifier circuit for the composite antenna element, wherein the composite antenna element is provided on an antenna substrate, and the amplifier circuit is provided on an amplifier substrate that is different from the antenna substrate.

13. The vehicle-mounted antenna device according to claim 4, further comprising an amplifier circuit for the composite antenna element, wherein the composite antenna element is provided on an antenna substrate, and the amplifier circuit is provided on an amplifier substrate that is different from the antenna substrate.

14. The vehicle-mounted antenna device according to claim 5, further comprising an amplifier circuit for the composite antenna element, wherein the composite antenna element is provided on an antenna substrate, and the amplifier circuit is provided on an amplifier substrate that is different from the antenna substrate.

15. The vehicle-mounted antenna device according to claim 2, wherein the composite antenna element is disposed such that a planar direction thereof is substantially perpendicular to the metal body of the vehicle.

16. The vehicle-mounted antenna device according to claim 3, wherein the composite antenna element is disposed such that a planar direction thereof is substantially perpendicular to the metal body of the vehicle.

17. The vehicle-mounted antenna device according to claim 4, wherein the composite antenna element is disposed such that a planar direction thereof is substantially perpendicular to the metal body of the vehicle.

18. The vehicle-mounted antenna device according to claim 5, wherein the composite antenna element is disposed such that a planar direction thereof is substantially perpendicular to the metal body of the vehicle.

19. The vehicle-mounted antenna device according to claim 1, wherein the first frequency band is an FM radio band and the second frequency band is an AM radio band.

* * * * *